United States Patent [19]

Snowden

[11] 4,378,606

[45] Apr. 5, 1983

[54] RAIN HAT

[76] Inventor: Maxine W. Snowden, 1628 15th St., NW., Washington, D.C. 20009

[21] Appl. No.: 309,986

[22] Filed: Oct. 9, 1981

[51] Int. Cl.[3] ..... A42B 1/02

[52] U.S. Cl. ..... 2/198

[58] Field of Search ..... 2/198, 174, 175

[56] References Cited

U.S. PATENT DOCUMENTS

| | | | |
|---|---|---|---|
| D. 13,323 | 3/1943 | Liberatore | 2/198 |
| 1,182,210 | 5/1916 | Rosenbaum | 2/198 |
| 1,207,440 | 12/1916 | Raudniz | 2/198 |
| 2,869,135 | 1/1959 | Wagenfeld | 2/198 |

*Primary Examiner*—Doris L. Troutman

*Attorney, Agent, or Firm*—Quaintance & Murphy

[57] ABSTRACT

A hat particularly suitable as a rain hat includes a crown portion having an inelastic front periphery and an elastic rear periphery. The crown portion is gathered adjacent to the front and rear peripheries so as to provide a relatively voluminous sack portion for enclosing the hair of the woman wearing the hat. The hat is pleated adjacent to the front periphery and has a brim which can either project over the wearer's forehead or tuck back beneath the crown of the hat. Preferably, the hat is made from a lightweight, wrinkle resistant, water repellent breatheable material such as QUIANA.

8 Claims, 5 Drawing Figures

RAIN HAT

FIELD OF THE INVENTION

The instant invention relates to hats or caps and, more particularly, the instant invention relates to hats or caps which are used generally as rainwear.

PRIOR ART AND OTHER CONSIDERATIONS

Most of the rainhats currently available for women are unattractive, uncomfortable, inconvenient and frequently ineffective. Many rain hats are nothing more than plastic kerchiefs which do not completely enclose the woman's hair and frequently mash her hair down when an attempt is made to tighten the tie of the kerchief. Other rain hats resemble shower caps and are considered by many women to be rather unsightly. Moreover, the shower cap-type rain hat is frequently hot and uncomfortable and usually does not have sufficient volume or flexibility to accommodate a full hair style.

There is also a need for some type of hat or cap which can be worn to cover rollers so that when women need to go out in public and have their hair in rollers, they can feel comfortable and attractive. The general practice now is to simply use a kerchief which does not effectively conceal the rollers.

In view of the aforementioned considerations, there is room for, and a need for, improvement in women's rain hats and other head coverings.

SUMMARY OF THE INVENTION

It is a feature of the instant invention to provide a new and improved head covering for women which is specifically suitable as rainwear as well as having other uses and which is attractive, convenient, effective and relatively inexpensive.

In view of the aforementioned feature, the instant invention contemplates a hat which includes a crown with a front periphery and a rear periphery joining the front periphery at spaced, opposed junctures to enclose a covering area. The front periphery is generally inelastic and has a series of spaced pleats adjacent thereto which extend a limited distance into the covering area to gather the covering area slightly. The rear periphery is elastic in order to gather the covering area therealong and in order to snugly fit the periphery of the hat to the wearer's head. By gathering the hat along the front periphery and the rear periphery, the covering area puffs to loosely enclose the wearer's hair and thereby protect her hair while leaving her hairstyle relatively undisturbed.

By spacing the pleats around the front of the hat, the front of the hat is stylish and attractive and by elastically gathering the rear edge of the hat, the hat fits snugly and is shaped into a rearwardly extending sack which encloses her hair.

DESCRIPTION OF THE PREFERRED EMBODIMENT

Figure 1:
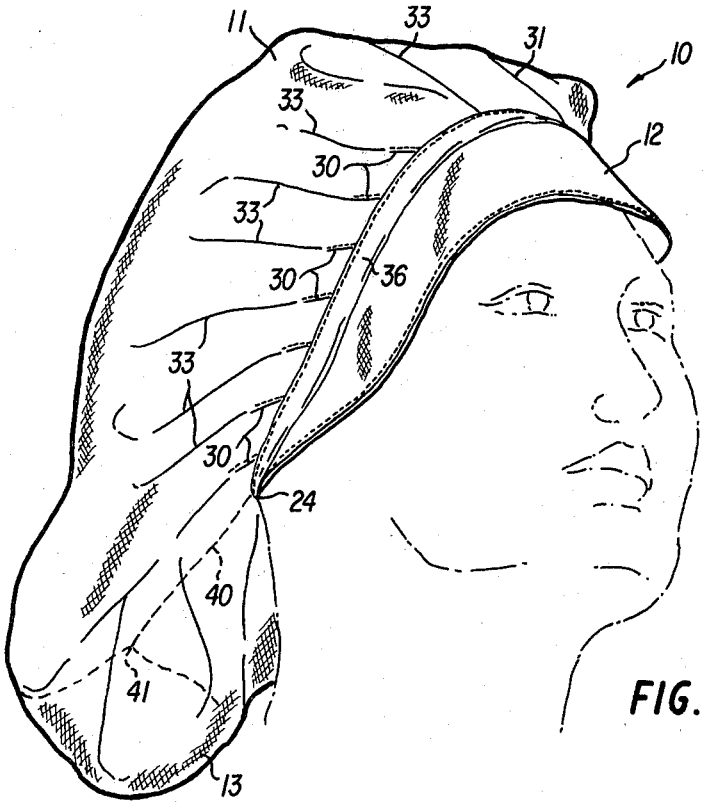
FIG. 1 is a perspective view of a rain hat in accordance with the instant invention being worn.
Figure 2:
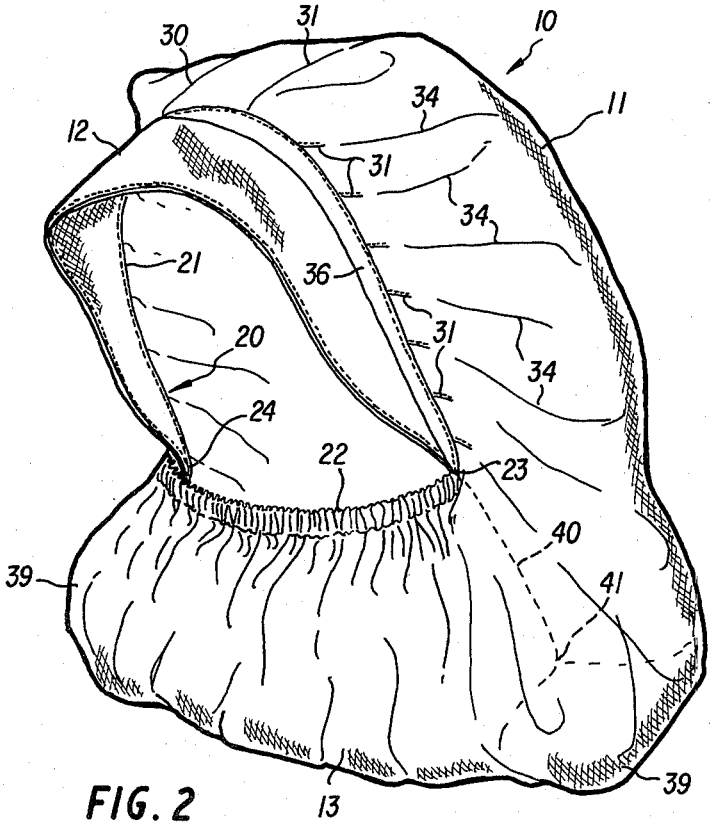
FIG. 2 is a perspective view of the rain hat of the instant invention showing the elastic rear periphery of the hat.
Figure 3:
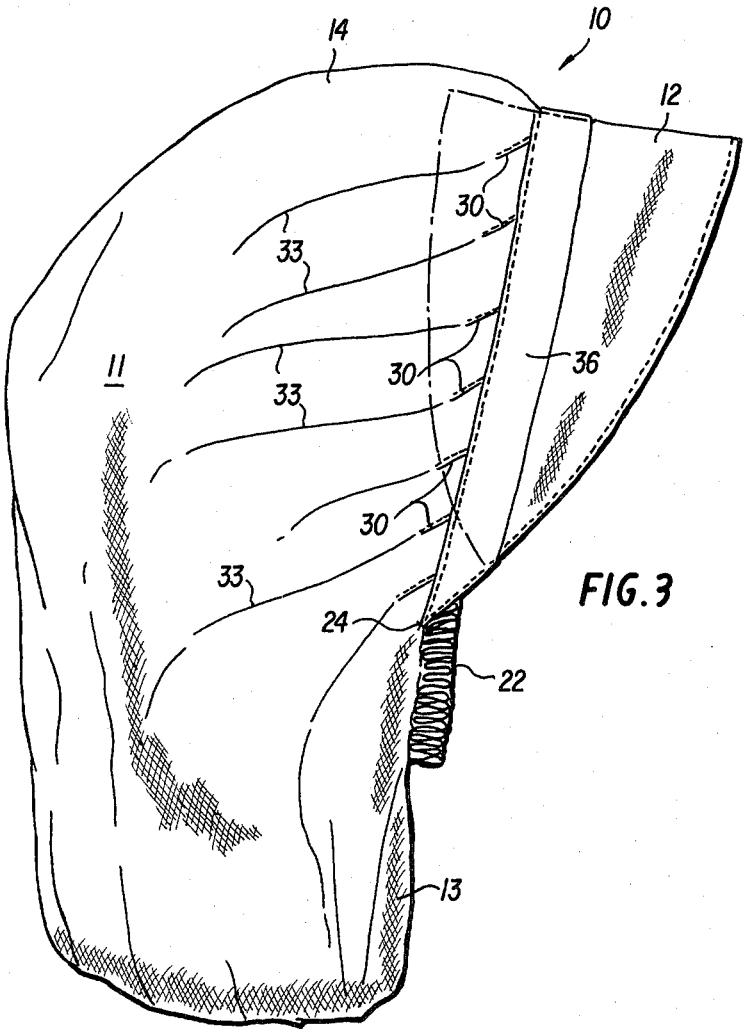
FIG. 3 is a side view of the rain hat showing in dotted lines how a brim on the hat can be folded back inside the crown.

Referring now to FIGS. 1, 2 and 3, there is shown a rain hat, designated generally by the numeral 10, which includes a crown 11 and a brim 12. The rain hat is preferably made of a lightweight, flexible material which breathes and which is fairly wrinkle resistant. A preferable material is QUIANA, which is a nylon product used in the manufacture of umbrellas. By utilizing this type of material, the rain hat 10 can be folded, rolled up or bunched into a compact package and carried in one's pocket or purse. Since the material of the rain hat 10 is wrinkle resistant, the rain hat can simply be shaken out and worn when needed.

The crown 11 is configured with a relatively voluminous sack portion 13 for enclosing a fairly full hairstype and a sloping peak portion 14 which extends upwardly and backwardly from the front of the hat 10. The peak portion 14 gives the hat 10 a stylish, attractive appearance and provides a relatively smooth flow from the front of the hat to the sack portion 13.

The perimeter, designated generally by the numeral 20, includes a front periphery 21 and a rear periphery 22. The rear periphery 22 extends between the ends of the front periphery 21 at spaced, opposed junctures 23 and 24. As is seen in FIGS. 2 and 3, the rear periphery 22 is closely gathered (by an elastic band) while the front periphery 21 is not closely gathered. As is seen in FIG. 1, the rear periphery 22 is generally concealed by the sack 13 when the hat 10 is being worn.

The front of the crown 11 includes a series of spaced seams 30 and 31 which extend from the front periphery 21 back into the covering portion (13 and 14) of the crown to form a series of spaced pleats 33 and 34. The seams 30 and 31 differ from one another in that the seams 30 fold down in one direction while the seams 31 fold down in the other direction. Consequently, the pleats 33 and 34 fold in opposite directions. This is done so that both the pleats 33 and the pleats 34 open downwardly in opposite directions on the left and right-hand sides of the crown 11. In order to provide an attractive appearance, the bottom portions of the seams 30 are covered by a band 36 which extends around the front periphery 21 of the crown 11. The brim 12 is stitched inboard of the band 36 so that the band serves as a flap which covers the brim 12 when the brim is extended, as is shown in solid lines in FIG. 3, and so that the edge of the brim 12 is not visible when the brim 12 is folded back into the hat, as shown by the dotted lines in FIG. 3.

In order to shape the crown 11 so that the sack portion 13 generally flares at its bottom end 39, a pair of French seams 40 extend from the junctures 23 and 24 (see FIGS. 1 and 2) out into the covering portion and stop to form internal peaks 41. In forming the French seams are generally hidden.

Figure 4:
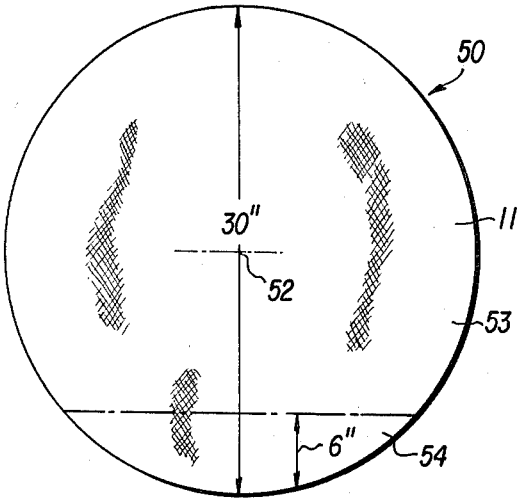
FIG. 4 is a planer view of the blank from which the rain hat of FIGS. 1–3 is made.
Figure 5:
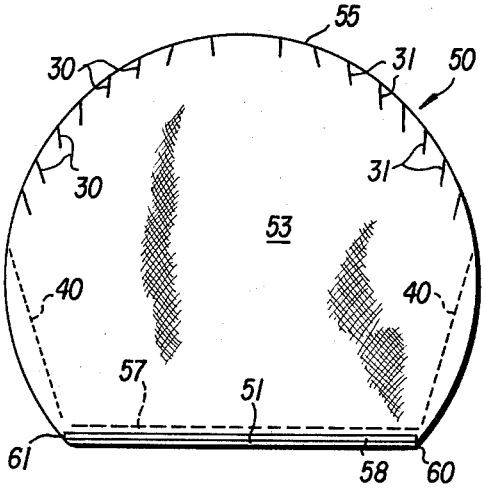
FIG. 5 is a planar view of the blank after the blank has been cut to form the crown and brim and showing various seams sewn in the blank during the process of forming the blank into the hat of FIGS. 1–3.

Referring now more specifically to FIGS. 4 and 5, the entire hat 10 shown in FIGS. 1–3 is manufactured from a circular blank, designated generally by the numeral 50. The first step in forming the hat is to cut the circular blank 50 along a line 51 to divide the blank into a crown portion 53 (which when hemmed and seamed forms the crown 11) and a brim portion 54 (which is subsequently attached to the crown along remaining circumference 55 to form the brim 12).

Preferably, the blank 50 is approximately thirty inches in diameter and the brim portion 54 is cut along a chord six inches from the center of the blank.

Referring now specifically to FIG. 5, the series of spaced seams 30 and 31 are sewn in the crown portion 53 in order to form the pleats 33 and 34. The seams 30 and 31 are tucked in opposite directions so that when the hat is worn, the pleats 33 and 34 will face outwardly and downwardly in opposite directions. The bottom periphery along the chord 51 is then folded over and hemmed to form a tube 57 into which an elastic band or strip 58 is inserted and attached at its ends 60 and 61 within the tube 57. When the band 58 is released, it gathers the chord 51 to form the rear periphery 22 as seen in FIGS. 2 and 3. The brim portion 54 is then folded over to form the band 36 and the brim 12 shown in FIGS. 1–3 and subsequently stitched along the remaining circumferential portion 55 with the band covering the outer ends of the seam 39 and forming a flap over the brim. The French seams 40 are sewn at a right angle to the chord 51 to tuck portions of the crown sac 13 inwardly by forming the inwardly porjection peaks 41.

The rain hat configured and manufactured in accordance with the aforedescriped structure is effective, comfortable, inexpensive and convenient. While the primary purpose of the hat is to protect the wearer from rain, the hat can also be used for other purposes such as concealing rollers and protecting one's hairstyle from wind.

The embodiment described thusfar is for illustrative purposes only and the invention is limited only by the following claims.

What is claimed is:

1. A hat comprising:

a crown having a front periphery and a rear periphery joining the front periphery at spaced, opposed junctures to enclose a covering area;

the front periphery being generally inelastic and having a series of spaced pleats adjacent thereto extending a limited distance into the covering area to gather the covering area; and A series of spaced seams sewn in said crown portions to form said pleats said seams are tucked in opposite directions so that when the hat is warn the pleats will face outwardly and downwardly in opposite directions the rear periphery being elastic to gather the covering area along the rear periphery whereby the covering area puffs to loosely enclose the wearer's hair while the front and rear peripheries fit snugly against the wearer's head generally adjacent the hairline.

2. The hat of claim 1 wherein the covering area includes a seam extending generally rearwardly from each juncture of the front and rear peripheries to form a pair of rearwardly extending tucks each terminating to define a peak in the covering area.

3. The hat of claim 1 or claim 2 further including a brim stitched to the front periphery.

4. The hat of claim 1 or 2 wherein there is a flexible brim stitched to the front periphery which can be folded out to shield the forehead or folded back beneath the covering area.

5. The hat of claim 1 or 2 wherein the hat is made of a lightweight, water repellent, but breatheable material such as QUIANA.

6. The hat of claim 1 or 2 wherein the crown is formed from a generally circular blank, the rear periphery thereof being formed along a chord cut through the generally circular blank and the front periphery being along the remaining circumferential periphery of the generally circular blank.

7. A rain hat comprising:

a crown formed from a generally circular blank of water repellent, breatheable material which is cut along a chord thereof to form a rear periphery; a front periphery of the crown being defined by the incut periphery of the blank, and the front and rear peripheries defining a covering area;

the front periphery being generally inelastic and having a series of spaced pleats adjacent thereto, the pleats extending a limited distance into the covering area to gather the covering area;

the rear periphery being folded and stitched to define a tube in which an elastic band is anchored to gather the rear periphery as the band contracts whereby the covering area puffs to loosely enclose the wearer's hair while the front and rear peripheries fit snugly against the wearer's head, generally adjacent to the hairline, a pair of seams extending generally rearwardly in the covering area from each juncture of the front and rear peripheries to form a pair of rearwardly extending tucks each terminating to define a peak in the covering area, and a brim formed from the portion of the blank severed to form the rear periphery of the crown, the brim being stitched inboard of the front periphery wherein a flap is formed between the front periphery and stitching for the brim, whereby the brim selectively projects from the front periphery or folds beneath the covering area.

8. The rain hat of claim 7 wherein one-half the seams sewn adjacent to the front periphery fold back in one direction toward the rear of the hat and the other half of the seams fold back in the other direction toward the rear of the hat.

* * * * *